US007992511B2

(12) United States Patent
Chon

(10) Patent No.: US 7,992,511 B2
(45) Date of Patent: Aug. 9, 2011

(54) INFLATABLE FLOOR FOR INFLATABLE BOAT

(75) Inventor: Dong Gyu Chon, Seoul (KR)

(73) Assignee: Bay Industrial Co., Ltd., Seoul (KR)

( * ) Notice: Subject to any disclaimer, the term of this patent is extended or adjusted under 35 U.S.C. 154(b) by 137 days.

(21) Appl. No.: 12/563,609

(22) Filed: Sep. 21, 2009

(65) Prior Publication Data

US 2011/0036284 A1 Feb. 17, 2011

(30) Foreign Application Priority Data

Aug. 12, 2009 (KR) ..... 10-2009-0074223

(51) Int. Cl.
*B63B 7/00* (2006.01)

(52) U.S. Cl. ..... 114/345

(58) Field of Classification Search ..... 114/345; 441/40

See application file for complete search history.

(56) References Cited

U.S. PATENT DOCUMENTS

| | | | | |
|---|---|---|---|---|
| 2,508,304 | A * | 5/1950 | Sturtevant | 114/345 |
| 4,251,893 | A * | 2/1981 | McCrory et al. | 114/345 |
| 4,462,331 | A * | 7/1984 | McCrory | 114/345 |
| 5,868,095 | A * | 2/1999 | Zeromski et al. | 114/345 |
| 6,209,476 | B1 * | 4/2001 | Maurel et al. | 114/345 |
| 7,159,529 | B2 * | 1/2007 | Durand et al. | 114/345 |
| 7,185,600 | B2 * | 3/2007 | Toussi et al. | 114/345 |
| 7,837,526 | B1 * | 11/2010 | Doffay | 441/40 |
| 2004/0244669 | A1 * | 12/2004 | Boudeau et al. | 114/345 |
| 2005/0126467 | A1 * | 6/2005 | Bouquard | 114/345 |

* cited by examiner

*Primary Examiner* — Stephen Avila
(74) *Attorney, Agent, or Firm* — IPLA P.A.; James E. Bame

(57) ABSTRACT

An inflatable floor for an inflatable boat acts as a keel using three inflatable floor layers. The uppermost first inflatable floor layer has a planar cross section. The second inflatable floor layer is located under the first inflatable floor layer. The third inflatable floor layer is located under the second inflatable floor layer. A plurality of threads are provided, in an X- or I-like configuration, inside air chambers of the three inflatable floor layers. The threads link the upper and lower walls of the air chamber of each respective inflatable floor layer to each other. The inflatable floor has increased buoyancy and stiffness, is easy to fold and transport and is easy and economical to repair or replace and thus is easily applicable to a large military or rescue inflatable boat.

5 Claims, 5 Drawing Sheets

INFLATABLE FLOOR FOR INFLATABLE BOAT

CROSS REFERENCE

This application claims priority to Korean Patent Application Number 10-2009-74223 filed on Aug. 12, 2009, the entire contents of which application is incorporated herein for all purposes by this reference.

BACKGROUND OF THE INVENTION

1. Field of the Invention

The present invention relates to an inflatable floor for an inflatable boat, in particular, to one which can act as a keel using three inflatable floor layers, which are bound to each other by ropes. Thereby, the inflatable floor can maintain stiffness so that a person can easily move inside the boat, enhance buoyancy to thereby increase capacity and minimize maintenance costs by facilitating partial replacement and/or repair even if one of the three inflatable floor layers is partially perforated or damaged. In addition, unlike a conventional inflatable boat, which must be packed by disassembling the bottom from the boat, the inflatable floor for an inflatable boat of the present invention can be packed together with the inflatable boat, and thus can be easily applied to a large inflatable boat such as a military or rescue boat, which is required to be rapidly assembled and disassembled.

2. Description of Related Art

In general, an inflatable boat is constructed with a floor defining a usable passenger/cargo space and inflatable tubes around the floor. The tubes are made of a flexible material such as rubber or polyvinyl chloride (PVC). When the tubes are inflated with air or gas, the inflatable boat is ready to float, propelled by a motor or paddles.

The conventional floor for an inflatable boat is manufactured using a sheet of plywood, aluminum, or the like. However, it is labor intensive to assemble and disassemble the floor to and from the boat. In addition, the floor is cumbersome since it is heavy and difficult to carry.

In order to solve these problems, inflatable boats having an inflatable floor, which can be filled with air, were introduced.

For example, as shown in FIG. 1A, a conventional inflatable boat 1 includes a floor 10, inflatable tubes 20 around the floor 10, and a V-shaped inflatable bottom 30 below the floor 10. With this configuration, the inflatable boat 1 can float using the buoyancy of the tubes 20 and the bottom 30, which are filled with air.

In the conventional inflatable boat 1 having the inflatable floor 10, the air-filled bottom 30 acts as the hull. However, the floor 10 is not stiff even if the bottom 30 is filled with air. Rather, the inflatable floor 10 is flexible and does not provide stable support for a person who steps on the floor 10 in the inflatable boat 1. As a result, it is difficult for the person to move inside the inflatable boat 1.

In this conventional structure, if the bottom 30 is punctured or torn, it no longer performs adequately as a hull due to air leakage. Then, the inflatable boat 1 has great difficulty in navigating, its ability to stay afloat is reduced, and passengers' safety may be threatened.

In order to overcome this problem, another conventional attempt is proposed in U.S. Pat. No. 5,868,095, entitled "INFLATABLE FLOOR, IN PARTICULAR FOR AN INFLATABLE BOAT." The inflatable floor of this document is illustrated in FIG. 1B.

In this attempt, an inflatable floor 50 is surrounded by inflatable tubes 60. The inflatable floor 50 includes an airtight compartment 70 defined between top and bottom walls 52*a* and 52*b*. In the airtight compartment 70, a plurality of I-oriented vertical threads 72 are connected with the top and bottom walls 52*a* and 52*b* such that the inflatable floor 50 can maintain a uniform thickness when filled with air.

A bottom 80 having a V-shaped cross section is provided under the inflatable floor 50, and a tube-like keel 90 is provided in the central portion of the bottom 80, extending lengthwise of the boat. The bottom 80 maintains a V-like configuration when the inflatable floor 50 and the keel 90 are filled with air.

The above-mentioned conventional inflatable floor 50 reduces the flexibility of the floor using the air-filled top and bottom walls 52*a* and 52*b* that enhance strength to some extent. However, even if air is filled into the inflatable floor 50, sufficient stiffness is not ensured. As a result, other parts of the floor 50, except for that portion which is directly over the keel 90, are still somewhat flexible—particularly in larger craft over 5 m in length—so that a person cannot easily move inside the boat. Accordingly, this attempt is not applicable to the manufacturing of a large inflatable boat having an overall length of 5 m or more.

The information disclosed in this Background of the Invention section is only for enhancement of understanding of the background of the invention and should not be taken as an acknowledgment or any form of suggestion that this information forms the prior art that is already known to a person skilled in the art.

BRIEF SUMMARY OF THE INVENTION

Various aspects of the present invention provide an inflatable floor for an inflatable boat, which maintains stiffness without requiring a keel under the inflatable floor, provides a stable space in the inflatable boat so that a person can easily move inside the boat, so that cargo can be carried in a stable fashion and is light and easily packed.

Various aspects of the present invention also provide an inflatable floor for an inflatable boat which minimizes maintenance costs by facilitating partial replacement and/or repair even if one of the three inflatable floor layers is partially perforated or damaged, as well as greatly increasing its own buoyancy and strength so as to be easily applicable to a large inflatable boat such as a military or rescue boat having an overall length of 5 m or more.

In an aspect of the present invention, the inflatable floor is provided in the bottom of an inflatable boat to form a floor of the inflatable boat. The inflatable floor may include a first inflatable floor layer having a horizontally-planar cross section, a second inflatable floor layer provided under the first inflatable floor layer, a third inflatable floor layer underlying the second inflatable floor layer, and a plurality of ropes. The first inflatable floor layer includes upper and lower walls bonded with each other along edges to define an inflatable air chamber between the upper and lower walls and a plurality of links formed on the edges thereof at predetermined intervals. The second inflatable floor layer may include a plurality of inner links formed on the upper portion thereof, the inner links corresponding to the links of the first inflatable floor layer. On the second layer, the upper and lower walls are also bonded with each other along edges thereof to define an inflatable air chamber between the upper and lower walls, and a plurality of outer links formed on edges thereof at predetermined intervals. The second inflatable floor layer may have such a shape that a concave space is formed between the first and second inflatable floor layers. The third inflatable floor layer may include upper and lower walls bonded with each other along edges to define an inflatable air chamber between the upper and lower walls and a plurality of links formed along edges thereof at predetermined intervals. The links of the third inflatable floor layer may correspond to outer links of the second inflatable floor layer. The ropes may bind the first and second inflatable floor layers by passing through the links of the first inflatable floor layer and the inner links of the second inflatable floor layer, and bind the second and third inflatable floor layers by passing through the outer links of the second inflatable floor layer and the links of the third inflatable floor layer. With this configuration, the inflatable floor realizes a three-ply structure, which can greatly enhance structural strength and buoyancy, thereby maintaining stiffness. Additionally, the entire boat may be deflated and packed for transportation or storage with the floor in place and ready for immediate deployment the next time that the boat is put into service, without having to install the floor separately.

The first inflatable floor layer may have a width smaller than that of the inflatable boat so as to be arranged longitudinally in the central portion of the inflatable boat. This, as a result, can further reinforce the structural stiffness of the central portion of the floor on which a large amount of load is applied.

The inner links of the second inflatable floor layer may be formed longitudinally on the upper central portion of the second inflatable floor layer so as to fit to intervals of the links of the first inflatable floor layer, respectively, such that the first inflatable floor layer can be arranged on the upper central portion of the second inflatable floor layer. The second inflatable floor layer may have a recess in the central portion thereof, which forms a cavity between the first and second inflatable floor layers, and a pair of slopes gradually ascending in opposite directions.

The links of the third inflatable floor layer may be formed along the edges of the third inflatable floor layer so as to fit to intervals of the outer links of the second inflatable floor layer, respectively. The third inflatable floor layer may have a recess in the central portion thereof and a pair of slopes gradually ascending in opposite directions, corresponding to the second inflatable floor layer. Accordingly, the second and third inflatable floor layers not only ensure the floor of the inflatable boat to be stiff but also form a V-shaped keel. With this configuration, when the boat is propelled forwards, the bottom central portion of the third inflatable floor layer cleaves the water so that the boat can travel with more stability.

The ropes may include a first rope connecting one edge of the first inflatable floor layer with the upper central portion of the second inflatable floor layer, a second rope connecting the other edge of the first inflatable floor layer with the upper central portion of the second inflatable floor layer, a third rope connecting one edge of the second inflatable floor layer with one edge of the third inflatable floor layer, and a fourth rope connecting the other edge of the second inflatable floor layer with the other edge of the third inflatable floor layer. Each of the ropes is inserted through the corresponding links, with both ends of the each rope knotted, such that the rope remains in the corresponding links and connects them tightly. With this configuration, the first, second, and third inflatable floor layers are tightly attached to each other using the ropes yet can be easily disassembled if required for maintenance, repair or partial replacement. This, as a result, minimizes maintenance costs.

In addition, each of the first, second, and third inflatable floor layers may include a plurality of threads, which are provided in an X- or I-like configuration inside the air chamber and are fixed to the upper and lower walls. Accordingly, each of the first, second, and third inflatable floor layers can expand to a predetermined size and maintain a uniform thickness when inflated with air.

According to exemplary embodiments of the present invention as set forth above, the three-ply structure of the first, second, and third inflatable floor layers can greatly enhance structural stiffness even if a keel is not provided. The V-like configuration of the second and third inflatable floor layers can act as a keel to maintain the stiffness of the floor, thereby helping the boat travel in a straight line.

In addition, the first inflatable floor layer is provided with the planar upper surface on the upper surface of the second inflatable floor layer so as to ensure a stable space in the boat so that a person can easily move inside the boat and to reinforce the stiffness of the central portion of the boat. In addition, if one of the first, second, and third inflatable floor layers is perforated or damaged, the damaged inflatable floor layer can be easily removed for replacement by untying the ropes from the damaged inflatable floor layer. Accordingly, parts can be easily replaced and/or repaired, thereby minimizing maintenance costs.

Moreover, the first, second, and third inflatable floor layers are configured to greatly increase buoyancy and stiffness and can be easily packed and carried along with the boat to thereby provide excellent mobility. Accordingly, the inflatable floor is easily applicable to a large inflatable boat such as a military or rescue boat having an overall length of 5 m or more.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1A:
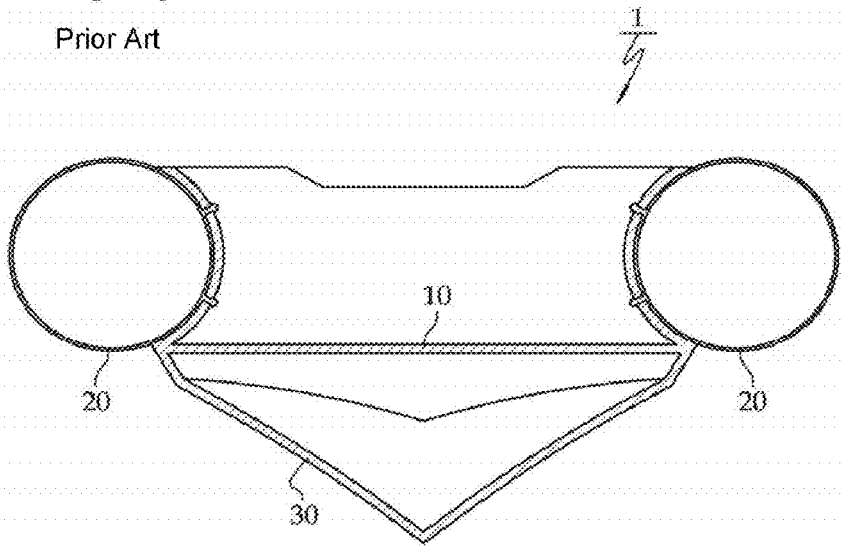
FIG. 1a Prior Art
FIG. 1A is a cross-sectional view illustrating a conventional inflatable boat having an inflatable floor.
Figure 1B:
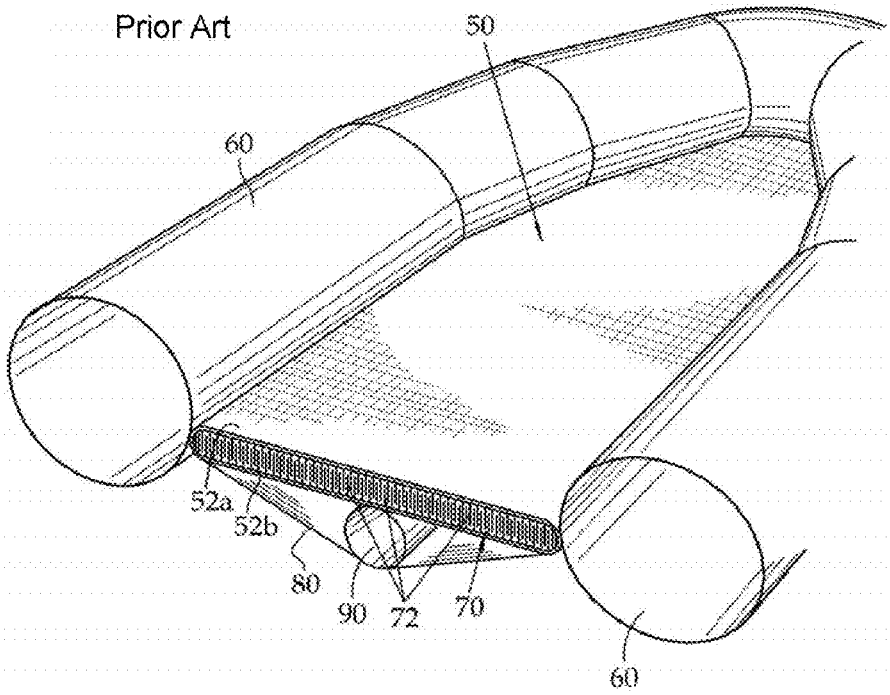
FIG. 1b Prior Art
FIG. 1B is a partially-cutaway perspective view illustrating another conventional inflatable boat having an inflatable floor with an inflatable keel between the inflatable floor and the centerline of the bottom.
Figure 2:
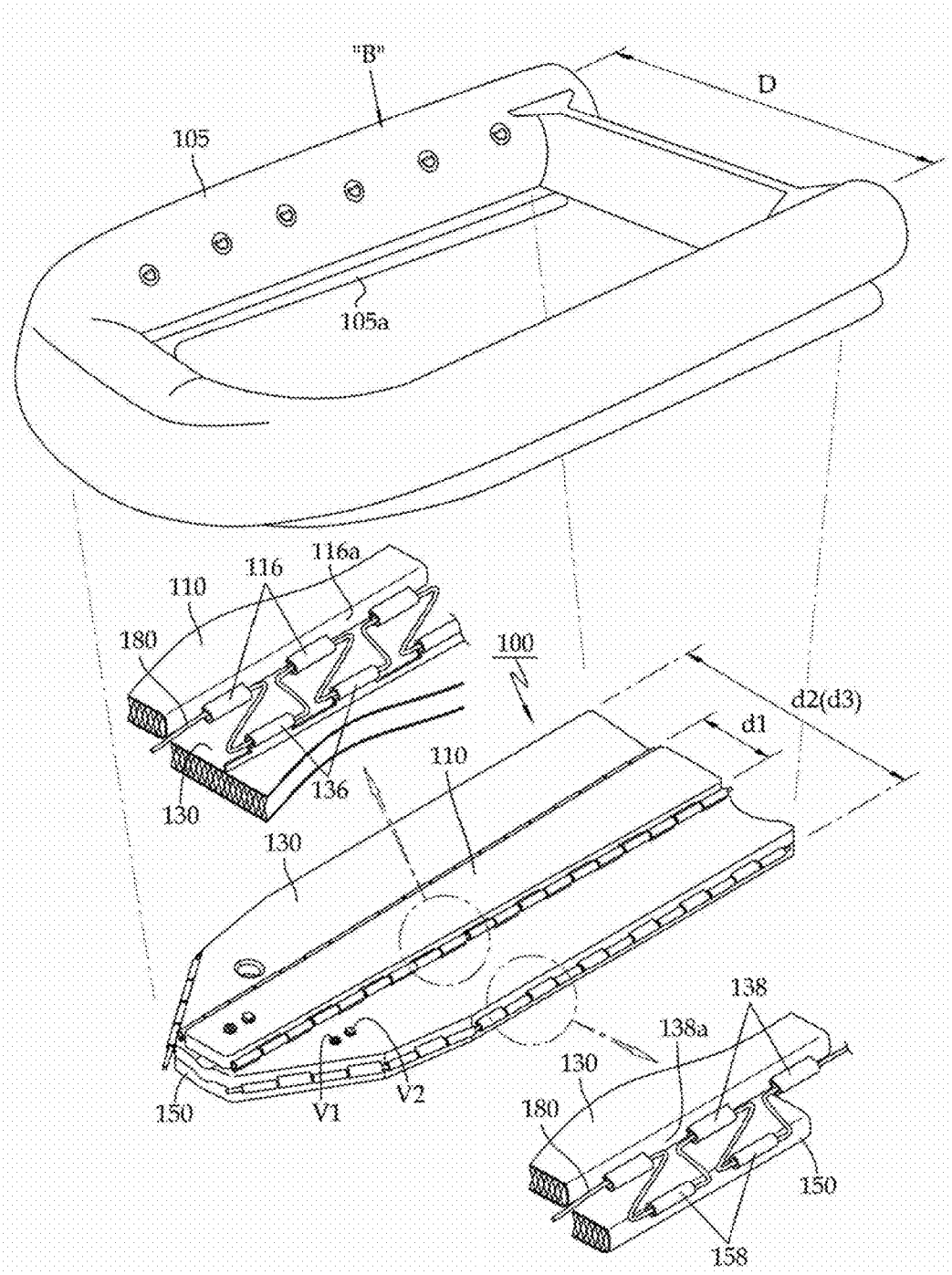
FIG. 2 is an exploded perspective view illustrating an inflatable boat, from which an inflatable floor for an inflatable boat in accordance with an exemplary embodiment of the invention is disassembled.

As shown in FIG. 2, an inflatable floor 100 for an inflatable boat in accordance with an exemplary embodiment of the invention is attached to the bottom of tubes 105 of an inflatable boat B, which maintain buoyancy using air or gas contained therein.

Figure 3:
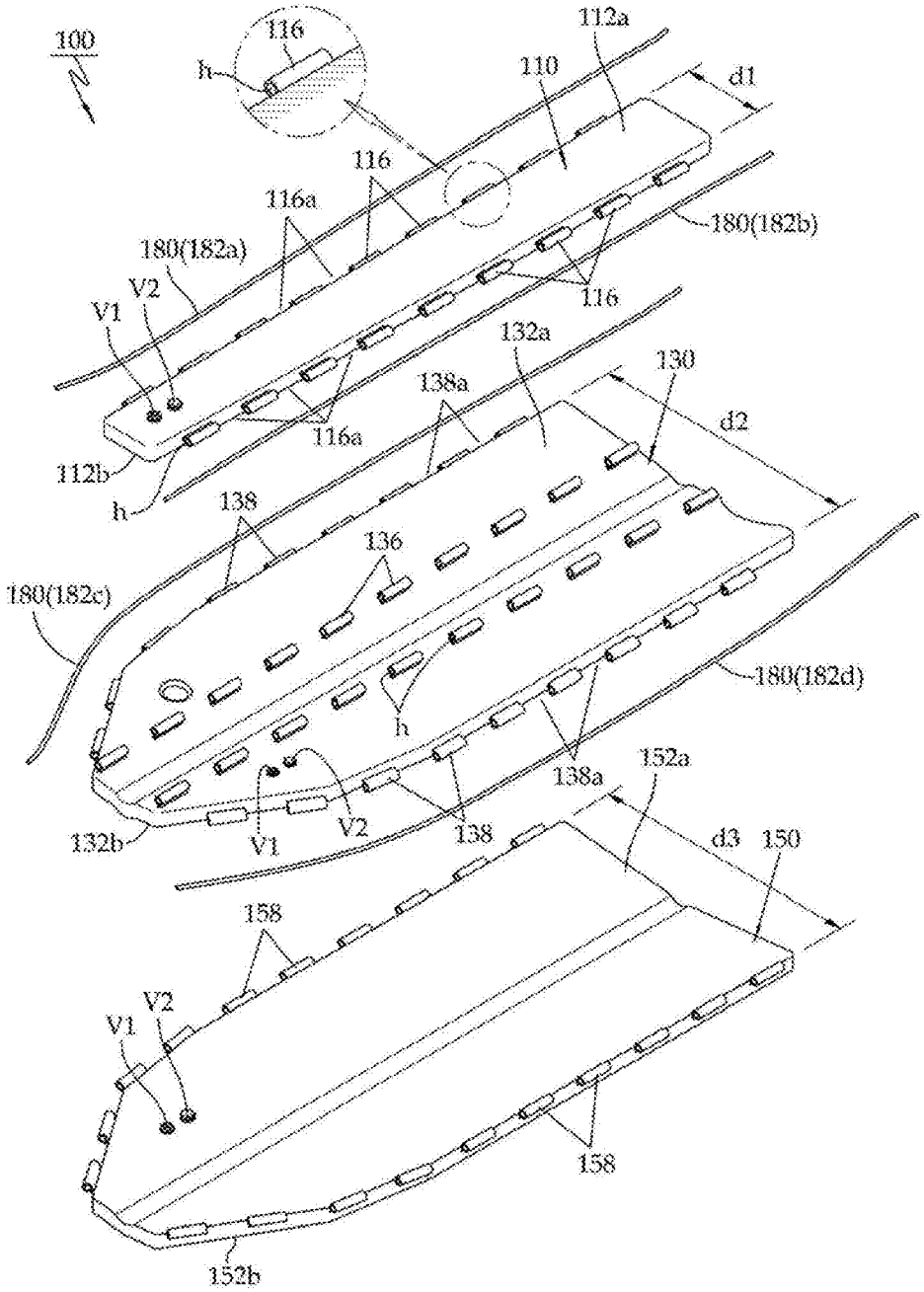
FIG. 3 is an exploded perspective view of the floor structure of the inflatable boat shown in FIG. 2.
Figure 4A:
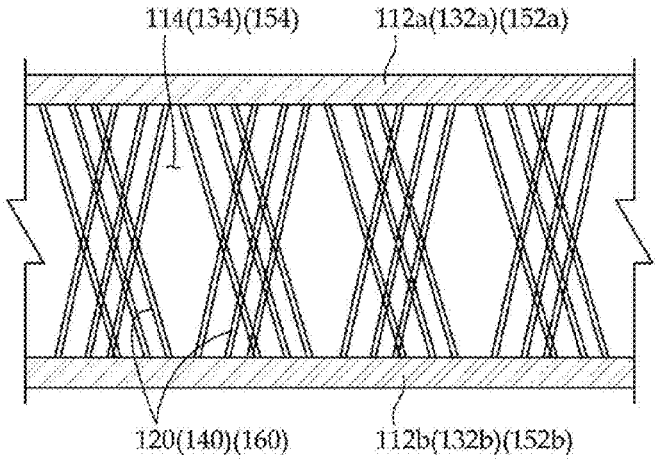
FIG. 4A is a partial cross-sectional view illustrating first, second, and third inflatable floor layers of the inflatable floor for the inflatable boat shown in FIG. 2.
Figure 4B:
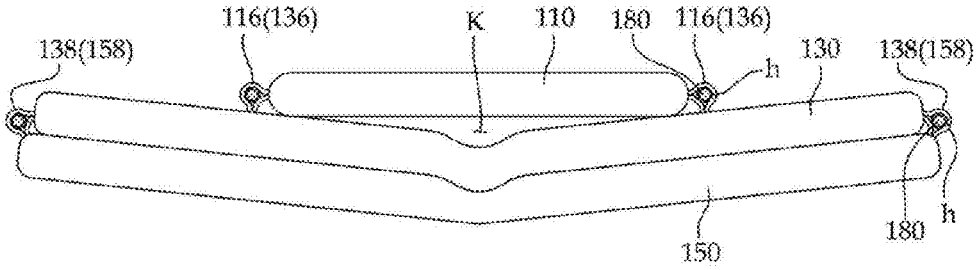
FIG. 4B is a rear elevation view illustrating an assembled state of the inflatable floor for the inflatable boat shown in FIG. 2.

The inflatable floor 100 for an inflatable boat of this embodiment includes a first inflatable floor layer 110 located in the upper side. As shown in FIGS. 3, 4A and 4B, the first inflatable floor layer 110 has a horizontally-planar cross section. The first inflatable floor layer 110 defines an inflatable air chamber 114 between upper and lower walls 112*a* and 112*b*, which are bonded with each other along the edges thereof. A plurality of links 116 are formed along both longitudinal edges of the first inflatable floor layer 110.

As shown in FIGS. 2 and 3, the first inflatable floor layer 110 has a width d1 smaller than the width D of the inflatable boat B, and is arranged longitudinally in the central portion of the inflatable boat B. As shown in FIG. 4A, the air chamber 114 is formed between the upper and lower walls 112 and 112*b*, which are bonded with each other along the edges. Inside the chamber 114, a plurality of threads 120 are provided in an X- or I-like configuration, each of which is fixed to the upper and lower walls 112*a* and 112*b*.

The inflatable floor 100 for an inflatable boat of this embodiment includes a second inflatable floor layer 130 under the first inflatable floor layer 110, which is arranged on the upper central portion of the second inflatable floor layer 130. The second inflatable floor layer 130 has a plurality of links 136 formed longitudinally on the upper central portion thereof, corresponding to the links 116 of the first inflatable floor layer 110.

The links 136 of the second inflatable floor layer 130 are positioned to alternate with the corresponding links 116 of the first inflatable floor layer 110.

As shown in FIGS. 2 and 3, the links 136 of the second inflatable floor layer 130 are inserted into intervals 116*a* of the links 116 of the first inflatable floor layer 110, respectively. When the first inflatable floor layer 110 is stacked on the second inflatable floor layer 130, the links 116 of the first inflatable floor layer 110 and the links 136 of the second inflatable floor layer 130 are fitted into each other to form a continuous line. The holes h of the links 116 and 136 conform to each other so that ropes 180 can extend through the inside of the links 116 and 136.

In addition, the second inflatable floor layer 130 defines an inflatable air chamber 134 between upper and lower walls 132*a* and 132*b*, which are bonded with each other at edges thereof, and has a plurality of links 138 formed on the edges. As shown in FIG. 4B, the second inflatable floor layer 130 has a V-shaped configuration. Specifically, the second inflatable floor layer 130 includes a recess in the central portion thereof, which forms a cavity K, and a pair of slopes gradually ascending in opposite directions. The cavity K is formed between the central portion of the second inflatable floor layer 130 and the first inflatable floor layer 110.

The second inflatable floor layer 130 has a width d2 greater than the width d1 of the first inflatable floor layer 110 such that the first inflatable floor layer 110 is arranged on the upper central portion of the second inflatable floor layer 130, but the width d2 of the second inflatable floor layer 130 is the same as or smaller than the width D of the inflatable boat B. As shown in FIG. 4A, the air filled chamber 134 is formed between the upper and lower walls 132*a* and 132*b*, which are bonded with each other along the edges. Inside the chamber 134, a plurality of threads 140 are provided in an X- or I-like configuration, each of which is fixed to both the upper and lower walls 132*a* and 132*b*.

The inflatable floor 100 for an inflatable boat of this embodiment includes a third inflatable floor layer 150 under the second inflatable floor layer 130.

The third inflatable floor layer 150 underlies the second inflatable floor layer 130, and has a width d3 the same as or greater than the width d2 of the second inflatable floor layer 130. The third inflatable floor layer 150 defines an inflatable air chamber 154 between the upper and lower walls 152*a* and 152*b*, which are bonded with each other on edges thereof. As shown in FIG. 4A, inside the air chamber 154, a plurality of threads 160 are provided in an X- or I-like configuration, each of which is fixed to the upper and lower walls 152*a* and 152*b*.

In addition, the third inflatable floor layer 150 has a plurality of links 158 formed longitudinally along the edges thereof, corresponding to the links 138 of the second inflatable floor layer 130. The third inflatable floor layer 150 has a configuration corresponding to that of the second inflatable floor layer 130. Specifically, the third inflatable floor layer 150 has a recess in the central portion and a pair of slopes gradually ascending in opposite directions. This configuration can provide a function similar to that of a keel.

To attach the third inflatable floor layer 150 to the second inflatable floor layer 130, the links 158 of the third inflatable floor layer 150 are inserted into the intervals of the links 138*a* of the second inflatable floor layer 130, respectively. When the second and third inflatable floor layers 130 and 150 are attached to each other, the links 138 and 158 are arrayed in a continuous line along the edges of the second inflatable floor layer 130 and the third inflatable floor layer 150 such that ropes 180 can extend through the links 138 and 158.

In addition, the inflatable floor 100 for an inflatable boat of this embodiment includes a plurality of ropes 180, which attach the first inflatable floor layer 110 and the second inflatable floor layer 130 to each other by passing through the links 116 and 136, and attach the second inflatable floor layer 130 and the third inflatable floor layer 150 by passing through the links 138 and 158.

As shown in FIG. 3, the ropes 180 include a first rope 182*a* connecting one longitudinal edge of the first inflatable floor layer 110 with the upper central portion of the second inflatable floor layer 130, a second rope 182*b* connecting the other longitudinal edge of the first inflatable floor layer 110 with the upper central portion of the second inflatable floor layer 130, a third rope 182*c* connecting one longitudinal edge of the second inflatable floor layer 130 with one longitudinal edge of the third inflatable floor layer 150, and a fourth rope 182*d* connecting the other longitudinal edge of the second inflatable floor layer 130 with the other longitudinal edge of the third inflatable floor layer 150.

The respective rope 180 is inserted through the links 116 and 136, or 138 and 158. Both ends of the rope 180 are knotted, such that the rope 180 does not come out of the links 116 and 136 or 138 and 158. With this configuration, the longitudinal edges of the first inflatable floor layer 110 and the upper central portion of the second inflatable floor layer 130 can be attached to each other using the first and second ropes 182*a* and 182*b*, respectively. Likewise, the longitudinal edges of the second inflatable floor layer 130 and the longitudinal edges of the third inflatable floor layer 150 can be attached to each other using the third and fourth ropes 182*c* and 182*d*, respectively.

In FIGS. 2 and 3, reference letter V1 indicates air injection valves, and reference letter V2 indicates over-pressure relief valves.

In order to assemble the inflatable floor 100 for an inflatable boat of this embodiment as configured above, the first inflatable floor layer 110, is placed upon the second inflatable floor layer 130 and the two layers are attached together using ropes 180 as follows: The first rope 182*a* is inserted through the links 116 and 136 of the first inflatable floor layer 110 and the second inflatable floor layer 130, on one longitudinal edge of the inflatable floor layer 110 and the corresponding upper central area of the second inflatable floor layer 130, then both ends of the rope 182*a* are knotted to attach the corresponding links 116 and 136 together. Likewise, the second rope 182*b* is inserted through the links 116 and 136 of the first inflatable floor layer 110 and the second inflatable floor layer 130, on the other longitudinal edge of the inflatable floor layer 110 and the corresponding upper central area of the second inflatable floor layer 130, then both ends of the rope 182*b* are knotted to attach the corresponding links 116 and 136 together.

Next, the assembled structure of the first inflatable floor layer 110 and the second inflatable floor layer 130 are place on top of the third inflatable floor layer 150 and the second inflatable floor layer 130 is attached to the third inflatable floor layer 150 using the ropes 180 as follows: The third rope 182*c* is inserted through the links 138 and 158 of the second inflatable floor layer 130 and the third inflatable floor layer 150 on one longitudinal edge of both inflatable floor layers 130 and 150, then the ends of the rope 182*c* are knotted to attach the corresponding links 138 and 158 together. Likewise, the fourth rope 182*d* is inserted through the links 138 and 158 of the second inflatable floor layer 130 and the third inflatable floor layer 150 on the other longitudinal edge of both inflatable floor layers 130 and 150, and then both ends of the rope 182*d* are knotted to attach the corresponding links 138 and 158 together.

When the entire inflatable floor structure is completely assembled, the first inflatable floor layer 110 is located in the uppermost position, the second inflatable floor layer 130 is located in the middle position and the third inflatable floor layer 150 is located in the lowermost position.

After the first, second, and third inflatable floor layers 110, 130, and 150 are attached to each other using the ropes 180, air is injected into the first, second, and third inflatable floor layers 110, 130, and 150 via the air injection valves V1 from either a manual pump or a gas supply tank (not shown).

With the air injected as above, the first inflatable floor layer 110 can maintain a uniform thickness when the upper and lower walls 112*a* and 112*b* are expanded. This is because the threads 120 are fixed in the X- or I-like configuration to both the upper and lower walls 112*a* and 112*b*, which are bonded at the edges to define the chamber 114. In the same manner, the second and third inflatable floor layers 130 and 150 when filled with air can maintain a uniform thickness when the upper and lower walls 132*a* and 132*b*; and 152*a* and 152*b* are expanded.

When the air is filled as above, the first, second, and third inflatable floor layers 110, 130, and 150, which are stacked one on another, form a three-ply structure. This, as a result, can greatly enhance structural strength and stiffness.

In this stacked structure, the first inflatable floor layer 110 is attached to the second inflatable floor layer 130 such that the planar upper surface of the first inflatable floor layer 110 is located at the same level as the top portion of the second inflatable floor layer 130 (which is not covered by the first inflatable floor layer 110). This, as a result, maintains the floor of the inflatable boat B in a planar shape, thereby easily ensuring a stable space in the boat so that a person can easily move and cargo can be easily stowed inside the inflatable boat B.

With the first, second, and third inflatable floor layers 110, 130, and 150 attached to each other as described above, as shown in FIG. 2, the inflatable floor 100 is fitted into a mounting area 105*a* formed by the lower portion of the tubes 105 of the inflatable boat B.

Figure 5:
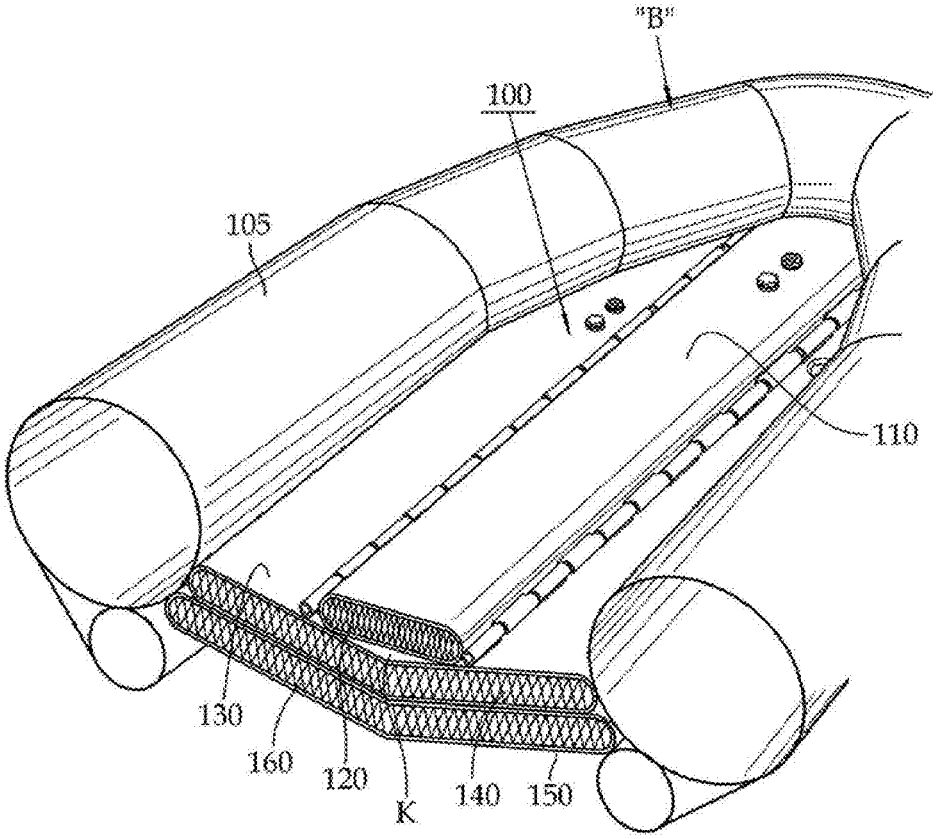
FIG. 5 is a partially cutaway perspective view illustrating the inflatable boat, to which the inflatable floor for the inflatable boat shown in FIG. 2 is assembled.

FIG. 5 is a partially-cutaway perspective view illustrating the inflatable boat B, in which the inflatable floor 100 for an inflatable boat of this embodiment is provided as the bottom of the inflatable boat B.

As can be seen from above, the inflatable boat B having the inflatable floor 100 for an inflatable boat of this embodiment has a stiff three-ply bottom such that a person can easily and stably move inside the inflatable boat B. When the air is evacuated, the inflatable boat B can be easily packed and conveniently carried, thereby ensuring excellent mobility.

If one of the first, second, or third inflatable floor layers 110, 130, and 150 is perforated or damaged, the damaged inflatable floor layer can be replaced by untying the ropes 180 from the damaged inflatable floor layer, whereas the remaining inflatable floor layers are still usable as they are. Accordingly, parts can be easily replaced and/or repaired, thereby minimizing maintenance costs.

Moreover, the first, second, and third inflatable floor layers 110, 130, and 150 stacked on and attached to each other are configured to greatly increase the buoyancy and stiffness the inflatable floor when filled with air thus increasing the boat's usable carrying capacity. Accordingly, the inflatable floor is easily applicable to a large inflatable boat such as a military or rescue boat having an overall length of 5 m or more.

The foregoing descriptions and following illustrations of specific exemplary embodiments of the present invention have been presented for purposes of illustration and description. They are not intended to be exhaustive or to limit the invention to the precise forms disclosed, and obviously many modifications and variations are possible to a person of ordinary skill in the art in light of the above teachings. For example, while the first, second, and third inflatable floor layers are bound to each other using the four (4) ropes, this is not intended to be limiting. Rather, the number of the ropes can be increased or reduced, for example, by binding the first and second inflatable floor layers using one rope and binding the second and third inflatable floor layers using one rope. However, it should be understood that such modifications, variations, and equivalents shall be considered to be within the scope of the present invention.

What is claimed is:

1. An inflatable floor provided in a bottom of an inflatable boat, comprising:

a first inflatable floor layer having a horizontally-planar cross section, wherein the first inflatable floor layer comprises: upper and lower walls bonded with each other along edges to define an inflatable air chamber between the upper and lower walls, and a plurality of links formed on edges thereof at predetermined intervals;

a second inflatable floor layer provided under the first inflatable floor layer, wherein the second inflatable floor layer comprises: a plurality of inner links formed on an upper portion thereof, the inner links corresponding to the links of the first inflatable floor layer, upper and lower walls bonded with each other along edges thereof to define an inflatable air chamber between the upper and lower walls, and a plurality of outer links formed on edges thereof at predetermined intervals, wherein the second inflatable floor layer is shaped such that a concave space is formed between the first and second inflatable floor layers;

a third inflatable floor layer underlying the second inflatable floor layer, wherein the third inflatable floor layer comprises: upper and lower walls bonded with each other along edges to define an inflatable air chamber between the upper and lower walls, and a plurality of links formed along edges thereof at predetermined intervals, the links corresponding to outer links of the second inflatable floor layer; and a plurality of ropes binding the first and second inflatable floor layers by passing through the links of the first inflatable floor layer and the inner links of the second inflatable floor layer and binding the second and third inflatable floor layers by passing through the outer links of the second inflatable floor layer and the links of the third inflatable floor layer, wherein the inflatable floor forms a floor of the boat when filled with air.

2. The inflatable floor in accordance with claim 1, wherein the first inflatable floor layer has a width smaller than that of the inflatable boat so as to be arranged longitudinally in a central portion of the inflatable boat.

3. The inflatable floor in accordance with claim 1, wherein the inner links of the second inflatable floor layer are formed longitudinally on an upper central portion of the second inflatable floor layer so as to fit to intervals of the links of the first inflatable floor layer, respectively, such that the first inflatable floor layer is arranged on the upper central portion of the second inflatable floor layer, and the second inflatable floor layer has a recess in a central portion thereof, which forms a cavity between the first and second inflatable floor layers, and a pair of slopes gradually ascending in opposite directions.

4. The inflatable floor in accordance with claim 1, wherein the links of the third inflatable floor layer are formed along the edges of the third inflatable floor layer so as to fit to intervals of the outer links of the second inflatable floor layer, respectively, and the third inflatable floor layer has a recess in a central portion thereof and a pair of slopes gradually ascending in opposite directions, corresponding to the second inflatable floor layer.

5. The inflatable floor in accordance with claim 1, wherein the ropes include a first rope connecting one edge of the first inflatable floor layer with the upper central portion of the second inflatable floor layer, a second rope connecting the other edge of the first inflatable floor layer with the upper central portion of the second inflatable floor layer, a third rope connecting one edge of the second inflatable floor layer with one edge of the third inflatable floor layer, and a fourth rope connecting the other edge of the second inflatable floor layer with the other edge of the third inflatable floor layer, and wherein each of the ropes is inserted through the links of adjoining layers of the inflatable floor layers, with both ends of the each rope knotted, such that the rope is retained within the corresponding links.

* * * * *